United States Patent [19]

Yoon

[11] 4,074,682

[45] Feb. 21, 1978

[54] COLLAPSIBLE TENT FRAME

[76] Inventor: Chong J. Yoon, 145 Conestoga St., Windsor, Conn. 06095

[21] Appl. No.: 739,932

[22] Filed: Nov. 8, 1976

[51] Int. Cl.[2] ..... A45F 1/16

[52] U.S. Cl. ..... 135/4 R; 52/63; 135/15 PQ; 135/20 M; 403/85; 403/100

[58] Field of Search ..... 135/2, 4 R, 20 M, 15 PQ; 52/63, 80; 403/85, 100

[56] References Cited

U.S. PATENT DOCUMENTS

| | | | |
|---|---|---|---|
| 33,959 | 12/1961 | Pullan | 135/4 R |
| 1,743,043 | 1/1930 | McLean | 403/100 |
| 2,530,765 | 11/1950 | Greenud | 135/4 R |
| 2,720,886 | 10/1955 | Byczek | 135/20 M |
| 3,563,592 | 2/1971 | Preston | 403/85 X |

FOREIGN PATENT DOCUMENTS

| | | | |
|---|---|---|---|
| 1,117,847 | 3/1956 | France | 135/4 R |
| 1,139,181 | 2/1957 | France | 135/4 R |

*Primary Examiner*—Werner H. Schroeder
*Assistant Examiner*—Conrad L. Berman
*Attorney, Agent, or Firm*—McCormick, Paulding & Huber

[57] ABSTRACT

A collapsible tent frame has all of its parts permanently connected to one another to provide a complete single unit and is easily changeable between a fully deployed condition, a partially deployed condition and a compact collapsed condition by simple manual manipulations. In either its fully deployed condition or its partially deployed condition, the frame is adapted to receive and support a tent fabric or other covering to provide a shelter lending itself to a variety of uses.

10 Claims, 16 Drawing Figures

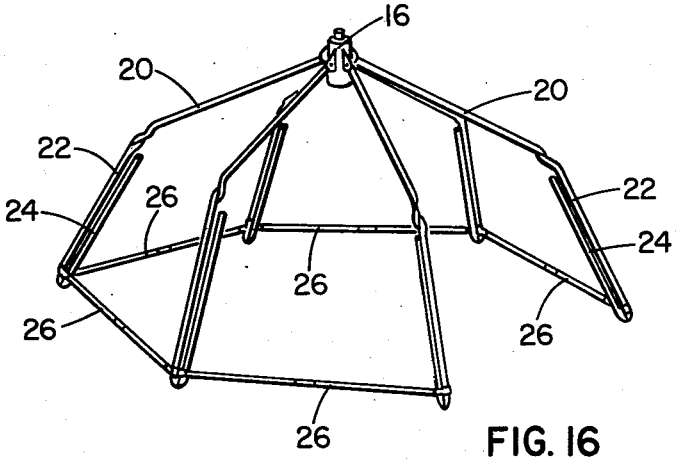
FIG. 16
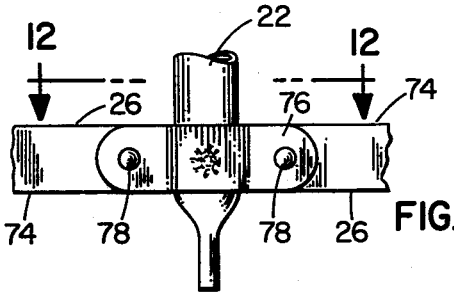
FIG. 11
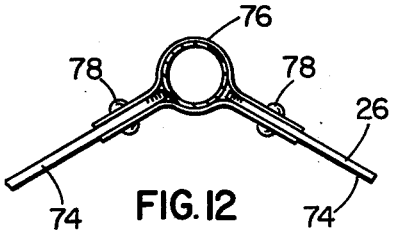
FIG. 12
FIG. 13
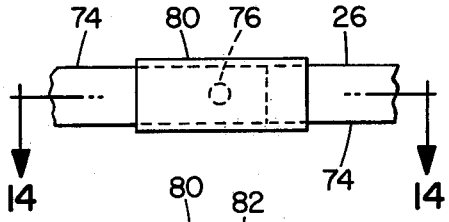
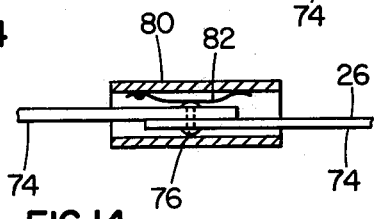
FIG. 14
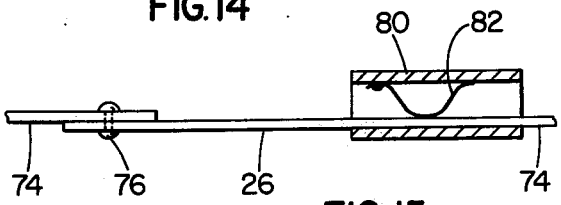
FIG. 15

COLLAPSIBLE TENT FRAME

BACKGROUND OF THE INVENTION

This invention relates to portable shelters of the type commonly referred to as tents and deals more particularly with a frame for such a shelter composed of a number of parts connected with one another and with an actuating mechanism so as to allow the frame to be either collapsed into a compact condition for convenience of storage or transportation or to be erected into one or more deployed conditions for service in supporting a fabric or other sheet-like wall member to provide a shelter.

A well known form of tent consists of a frame which rests on the ground and supports a thin flexible wall member to envelope and cover the space generally defined by the frame. Commonly, the frames for such tents are made of a number of separable parts, often tubular, which are disassembled from one another when the tent is not in use and which are reassembled, often by telescopic slip fit joints, to define the complete frame when the tent is again erected. Thus, there are problems of possible loss of frame parts while the tent is not in use and in properly and speedily reconnecting the parts to one another during subsequent reassembly.

In tent frames of the above-mentioned type it is also known to permanently connect some of the parts of the frame to one another and to make them collapsible, but generally such frames still include some parts designed to be completely disassembled from others when the frame is collapsed, and the collapsing procedure and mechanism are usually difficult and complicated. Also, prior tent frames have generally had only one deployed condition to provide only one form of structure and have not been adapted to provide any alternate form of structure.

A general object of this invention is, therefore, to provide an improved collapsible tent frame which is easily manually shifted between a compact collapsed condition and a deployed condition in which deployed condition it is useful in supporting a fabric or other wall-defining sheet of material to provide a structure.

A further object of the invention is to provide a collapsible tent frame in which all parts of the frame are permanently connected with one another so as not to be subject to loss during storage or transportation of the frame and so as not to require any reassembly when the frame is erected from a collapsed condition.

A still further object of the invention is to provide a tent frame of the foregoing character having two different deployed forms so as to be serviceable in providing two different types or shapes of shelter, the shelters provided by the frame being adaptable to a wide variety of uses such as a mountain camp tent, a roadside overnight sleeping tent, a beach parasol, a back yard screened porch, a farmer's field house, a battlefield command post, etc.

Other objects and advantages of the invention will be apparent from the following detailed description of the preferred embodiment and the accompanying drawings.

SUMMARY OF THE INVENTION

This invention resides in tent frames for providing, in combination with an associated covering fabric, a tent type shelter of various different uses. The frame is unitized insofar as all of its parts are permanently connected with one another and it is shiftable between a compact collapsed condition and at least one deployed condition.

In particular, the invention resides in the frame being composed of a central hub, a plurality of legs spaced angularly of one another about the central axis of the hub with each leg including a plurality of sections pivotally connected to one another to enable them to be moved between a relatively spread condition and a relatively folded condition. An inboard section of each leg is further pivotally connected to the hub for movement relative to the hub about a pivot axis located in a plane perpendicular to the hub central axis and perpendicular to a radial line to the central axis, thereby enabling such inboard leg section to be moved between a collapsed position at which it is arranged generally parallel to the central axis of the hub and a deployed position at which it extends generally radially outwardly from the central axis of the hub. The hub also carries a manually rotatable part for simultaneously moving all of the inboard sections of the legs relative to the hub in either a deploying or a collapsing direction depending on the direction of rotation of the rotatable part.

A more specific aspect of the invention resides in each leg of the frame including an inboard section, an intermediate section and an outboard section with the outboard section being pivotally connected with the intermediate section for movement relative to the intermediate section between a folded condition and a spread condition. The intermediate section is also pivotally connected to the inboard section for pivotal movement between folded and spread conditions relative to the inboard section; and likewise, as previously mentioned, the inboard section is movable relative to the hub between deployed and collapsed positions. When all of the inboard sections are deployed relative to the hub and all of the intermediate sections are spread relative to the inboard sections, the outboard sections may be either spread relative to the intermediate sections to provide a fully deployed frame providing one form of structure, or the outboard sections may be folded relative to the intermediate sections to provide a partially deployed frame providing another form of structure. In either the fully deployed condition or the partially deployed condition of the frame, struts extending between adjacent pairs of legs aid in controlling the angular spacing of the legs and in thus rigidifying the frame, the struts each being made of two arms pivotally connected to one another and to their associated legs to permit collapsing of the frame.

BRIEF DESCRIPTION OF THE DRAWINGS

FIG. 11 is a fragmentary elevational view showing the manner in which the struts are connected to a leg.

FIG. 12 is a view taken generally on the line 12—12 of FIG. 11.

FIG. 13 is an elevational view taken in the vicinity of the pivotal connection between two arms of a strut and showing the locking sleeve for holding the arms in their aligned condition.

FIG. 14 is a sectional view taken on the line 14—14 of FIG. 13.

FIG. 15 is a view similar to FIG. 14 but showing the locking sleeve moved to its released position.

FIG. 16 is a view similar to FIG. 2 but shows the frame in a partially deployed condition so as to define a different form of structure than it does in the fully deployed condition of FIG. 2.

DETAILED DESCRIPTION OF THE PREFERRED EMBODIMENT

Figure 1:
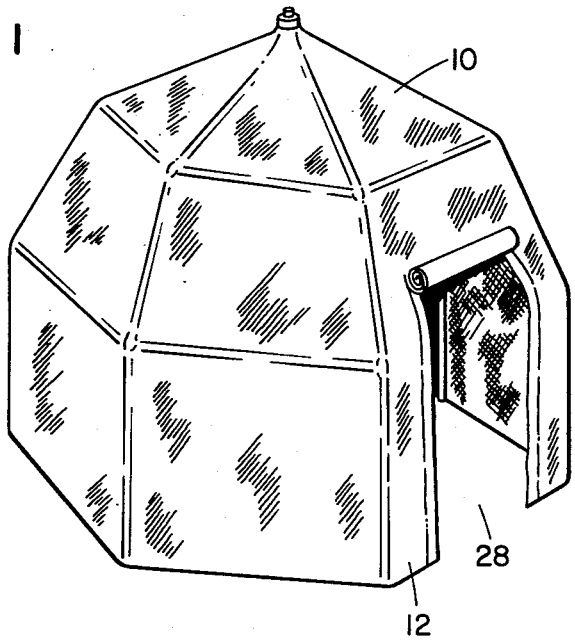
FIG. 1 is a perspective view of a shelter utilizing a fully deployed tent frame embodying the present invention.

In FIG. 1, a tent 10 is shown made of a fabric cover or wall member 12 draped over and suspended by a frame embodying the present invention. The frame itself is shown in FIG. 2 and is indicated generally at 14.

Figure 2:
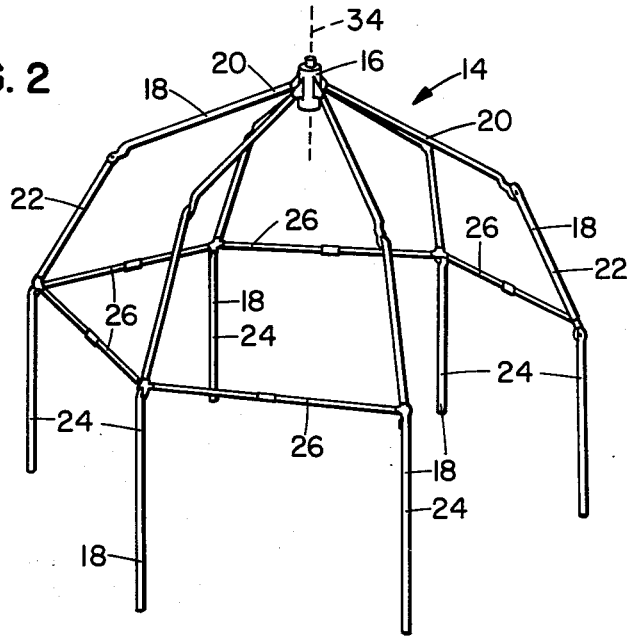
FIG. 2 is a view similar to FIG. 1 but showing the tent frame of the shelter by itself without its associated cover.

In FIG. 2, the frame is shown in what is referred to as its "fully deployed" condition to define with the wall member 12 the tent 10 of FIG. 1. In addition to its fully deployed condition, the frame also has a "partially deployed" condition, as shown in FIG. 16 and described in more detail hereinafter, for use in providing a different form or shape of shelter in combination with an appropriate wall member. Also, in addition to these two deployed conditions, the frame further has a collapsed condition, such as shown in FIG. 5 and described in more detail hereinafter, in which its parts are compactly arranged for convenience of storage and transportation.

Figure 3:
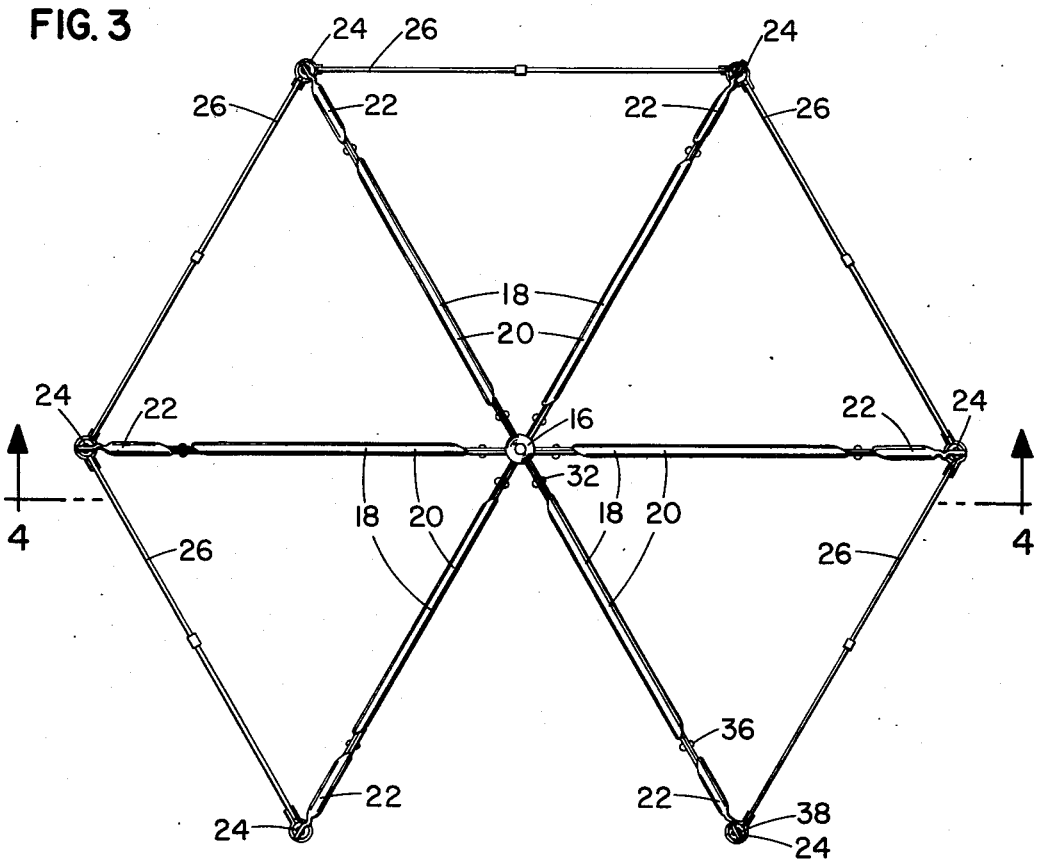
FIG. 3 is a top view of the frame of FIG. 2.
Figure 4:
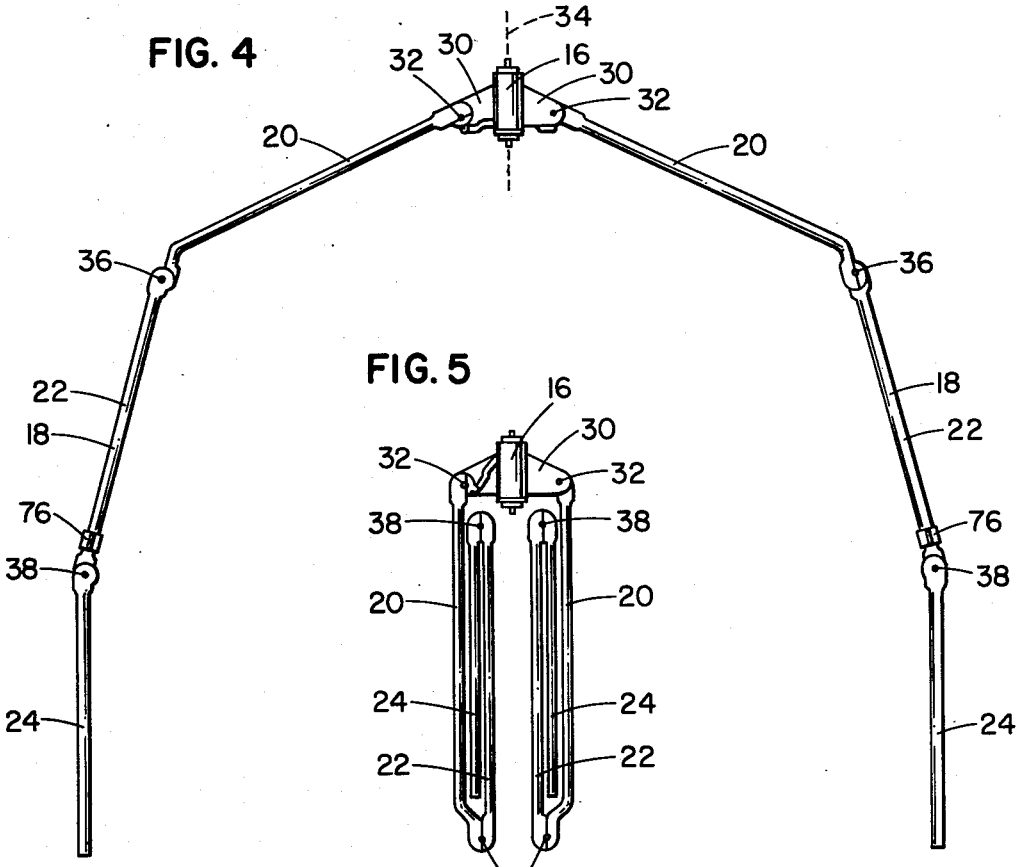
FIG. 4 is a vertical sectional view taken on the line 4—4 of FIG. 3.

Referring to FIGS. 2, 3 and 4, the frame 14 consists basically of a central hub 16 and six legs 18, 18 which are equally angularly spaced about the central axis 34 of the hub 16 and which, in the deployed condition of FIG. 2, extend generally outwardly and downwardly from the hub. Each leg 18 in turn includes an inboard section 20, an intermediate section 22 and an outboard section 24. Struts 26, 26 extend between each adjacent pair of legs 18, 18, except for the pair between which the door or entrance 28 is to be located, to hold, when the frame is deployed, the legs in fixed angular spacing to one another and to thereby rigidify the frame.

Figure 5:
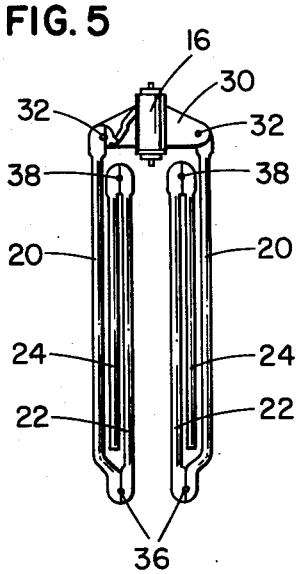
FIG. 5 is a view similar to FIG. 4 but showing the frame in its fully collapsed condition.
Figure 6:
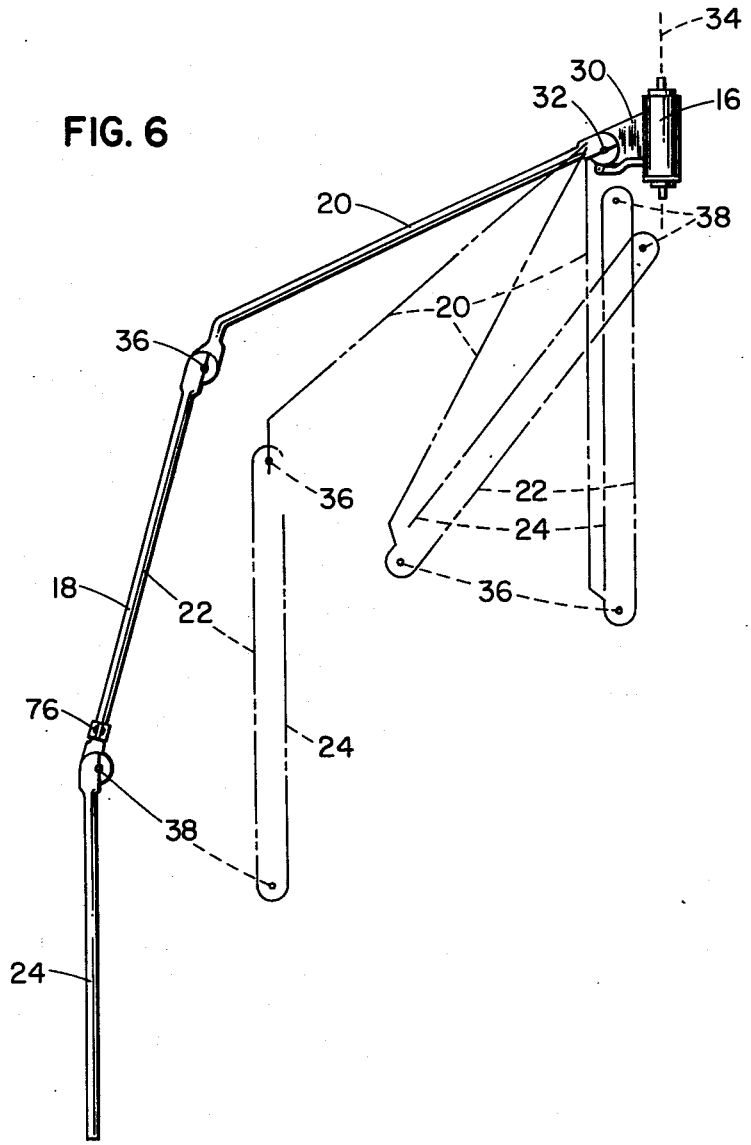
FIG. 6 is a view showing the manner in which one of the legs of the tent frame, as seen in FIG. 4, may be moved from its fully deployed condition to its fully collapsed condition.

As seen best in FIGS. 4, 5 and 6, the three sections of each leg are pivotally connected to the hub 16 and to one another. In particular, the hub 16 includes six radially extending ears 30, 30 and each inboard leg section 20 has an inboard end which is connected to a respective one of the hub ears for rotation of it relative to the hub about a pivot axis 32 located in a plane perpendicular to the central axis 34 of the hub and perpendicular to a radial line from such axis. Therefore, the inboard section 20 is pivotally movable relative to the hub 16 from a deployed position, as shown by the solid lines in FIG. 6, whereat it extends generally radially outwardly from the hub to a collapsed position, as shown by one of the broken line showings of FIG. 6, at which it is arranged generally parallel to the hub central axis 34.

Likewise, the intermediate section 22 of each leg is connected to its associated inboard section 20 for pivotal movement relative thereto about a pivot axis 36 located in a plane perpendicular to the hub central axis 34 and perpendicular to a radial line from such axis; and, the outboard section 24 is connected to the intermediate section 22 for pivotal movement relative thereto about a pivot axis 38 also located in a plane perpendicular to the axis 34 and perpendicular to a radial line from such axis. Thus, from the relatively spread or deployed conditions of the leg sections as shown in FIG. 4, the intermediate section 22 of each leg may be moved about the pivot axis 36 to a folded condition relative to the section 20 and the outboard section 24 may be moved about the pivot axis 38 to a folded condition relative to the section 22, such relatively folded conditions being shown by FIG. 5.

Figure 7:
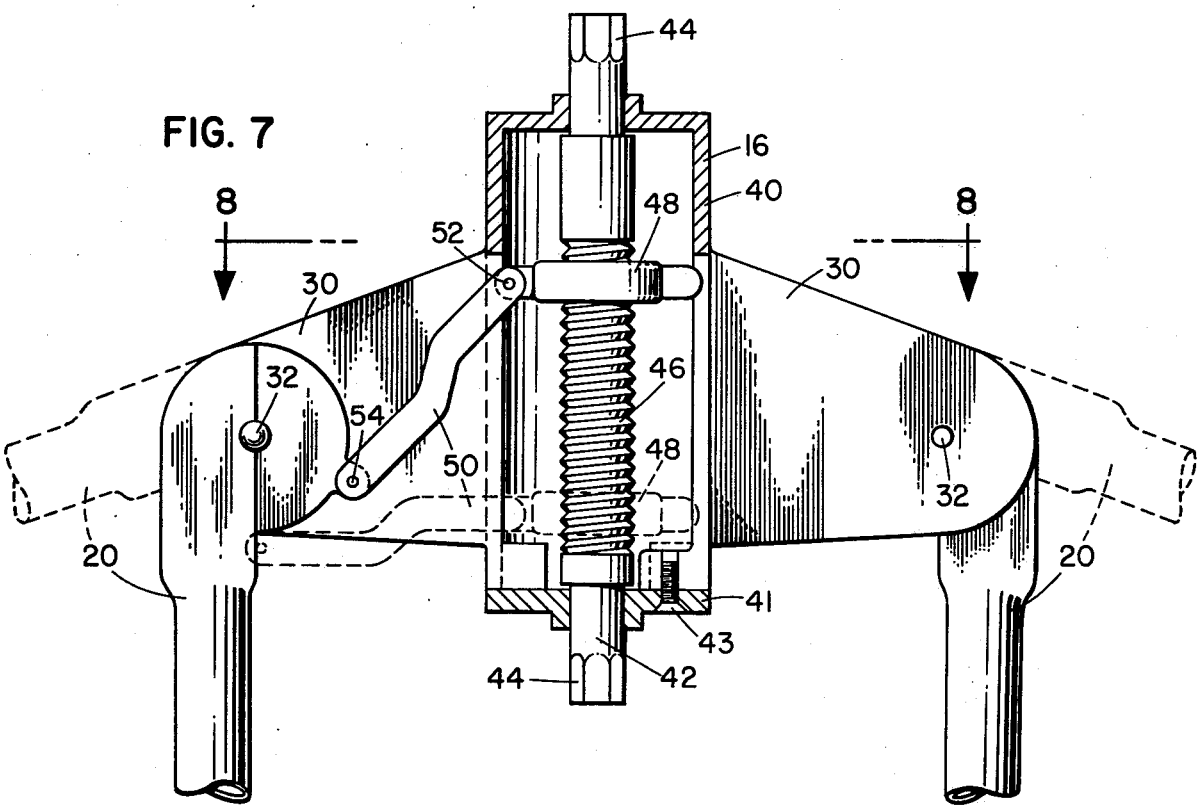
FIG. 7 is a view, partly in elevation and partly in vertical section, taken through the hub of the frame of FIG. 2.
Figure 8:
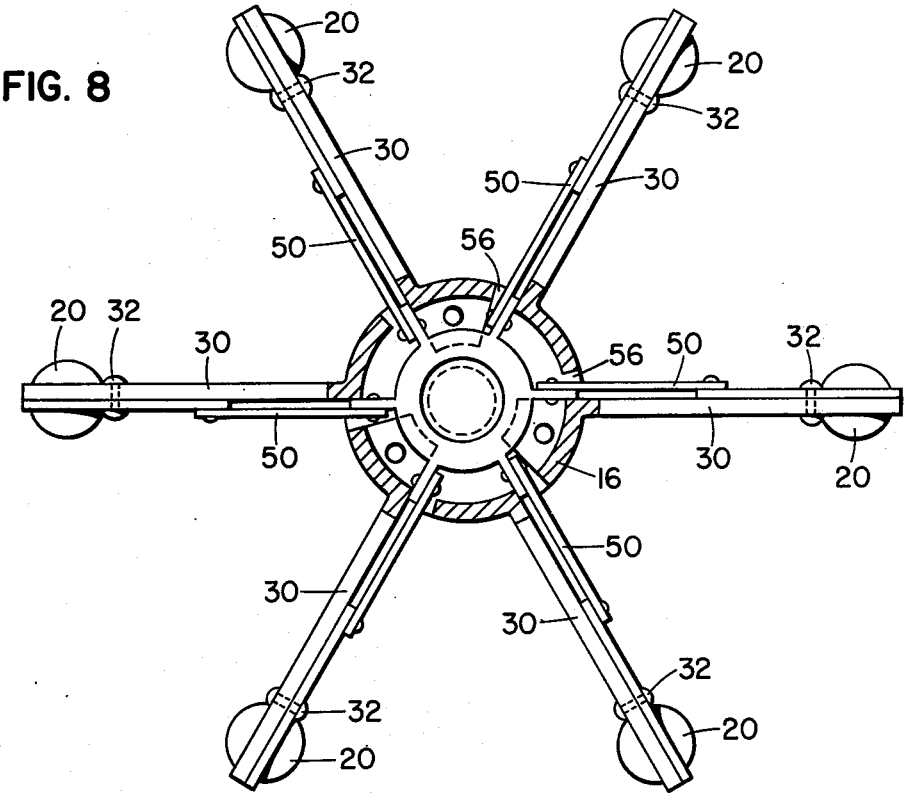
FIG. 8 is a horizontal sectional view taken on the line 8—8 of FIG. 7.
Figure 9:
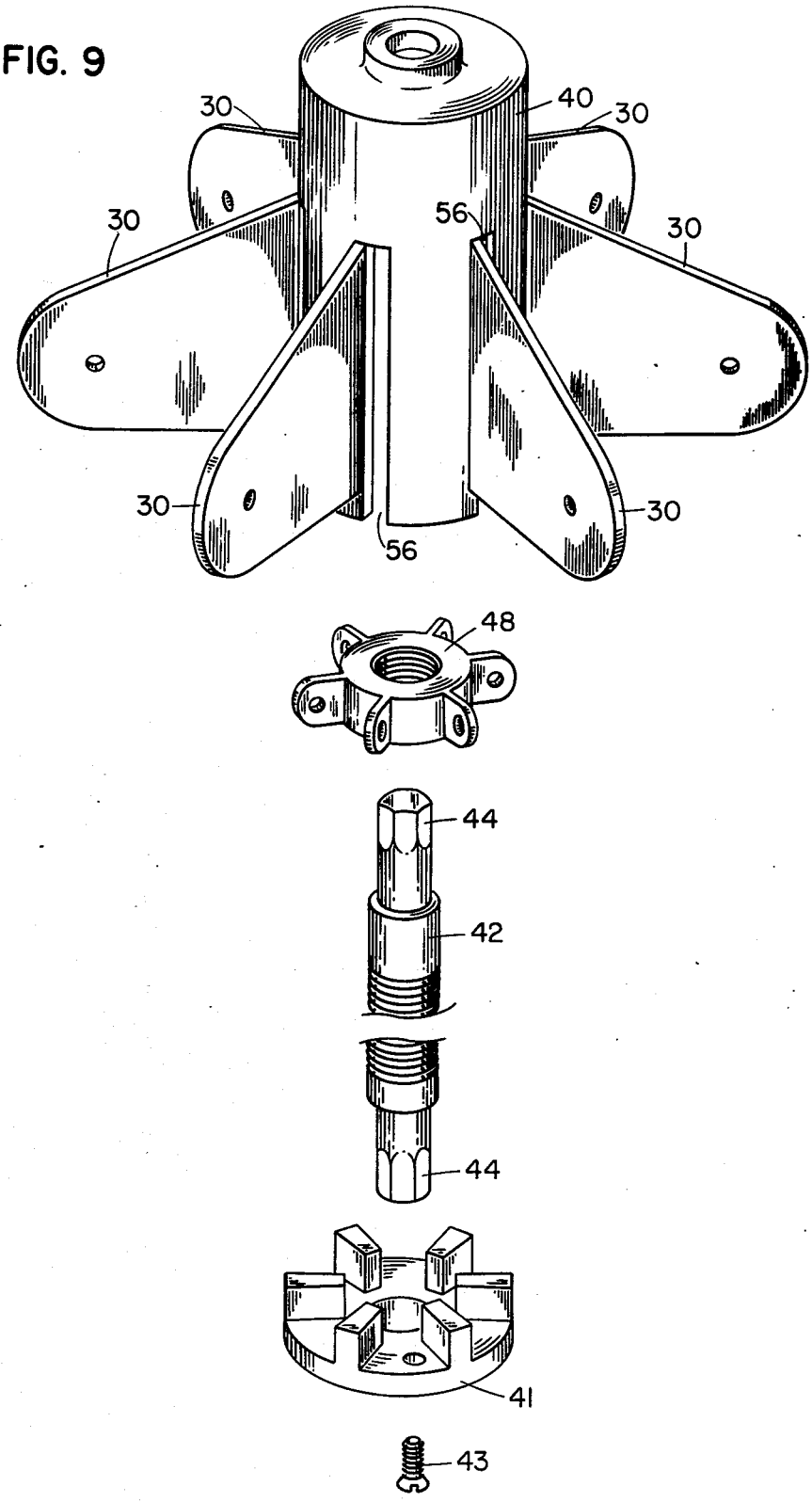
FIG. 9 is an exploded perspective view of the hub and actuating mechanism of the frame of FIG. 2.

In keeping with the invention, the hub 16 includes a manually operable mechanism for simultaneously moving the inboard sections 20, 20 of the legs 18, 18 between their deployed and collapsed positions to facilitate the deployment and collapsement of the frame. As to this, and as seen best in FIGS. 7, 8 and 9, the hub 16 includes a hollow central body 40, with an end closure 41 held to the body by screws 43, which rotatably supports an elongated operating member 42 having end portions 44, 44 extending from opposite ends of the hub body 40. Within the body 40 the member 42 includes a threaded portion 46 which threadably receives a driving member 48. The opposite end portions 44, 44 are each shaped to receive and cooperate with a tool for manually rotating the part 42 relative to the hub body 40. In FIGS. 7 and 9, the end portions 44, 44 are shown, for example, to be provided with hexagonal cross-sectional shapes to cooperate with a wrench having a conforming hexagonal socket opening but, of course, various different adaptations of the end portions may be provided for cooperation with different forms of tools without departing from the invention.

The driving member 48 moves axially of the part 42 as the part is rotated with the direction of its movement being dependent on the direction of rotation of the part 42. Connected between the driving part 48 and the leg sections 20, 20 are six links 50, 50 each associated with a respective one of the leg sections. Each link 50 is pivotally connected to the member 48, as at 52, and to its associated leg 20, as at 54, and fits through an elongated slot 56 in the hub body 40. Accordingly, it will be obvious from FIG. 7 that by rotation of the part 42 the driving member 48 and leg sections 20, 20 are movable between the collapsed positions indicated by the solid lines and the deployed positions illustrated by the broken lines.

Figure 10:
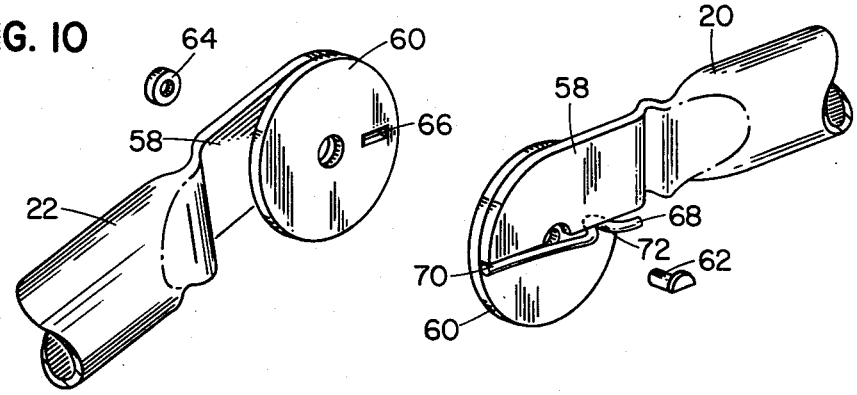
FIG. 10 is an exploded perspective view showing the structure of one of the joints between the sections of a leg of the tent frame of FIG. 2.

FIG. 10 shows the construction of one of the joints between a leg section 20 and leg section 22. The same construction is used for all of the joints at the pivot axes 36 and 38, and the construction is such that the joined leg sections are releasably held locked in their relative positions, shown in FIG. 2, corresponding to the fully deployed state of the frame. In particular, at each joint, the adjacent end portions of the leg sections are flattened as indicated at 58 and each has spot welded to the flattened area bearing washer 60. The two sections are joined by a pivot pin 62 extending through appropriate openings in the leg sections and bearing washers and peened or riveted over a collar 64. Each bearing washer 62 includes a locking opening 66. One bearing washer 60 carries a locking spring 68. This spring 68 is spot welded to its washer 60 at the end 70 and at its opposite end includes a bent finger 72 adapted to extend through the locking opening 66 in its washer 60 and into the locking opening 66 of the opposite washer 60. That is, when the two leg sections 20 and 22 are in their relatively spread or deployed positions, the finger 72 of the spring 68 fits through the opening 66 in its washer 60 and into the opening 66 of the opposite washer 62 to hold the sections 20 and 22 in such relative positions. To release the two leg sections for movement to their relatively folded or collapsed positions, the spring 68 may be deflected, by applying finger pressure to its right-hand end as seen in FIG. 2, to move the finger 72 out of the opening 66 of the opposite washer 60 and to thereby free the parts for pivotal movement about the pivot pin 62.

FIGS. 11 through 15 show the construction of the struts 26, 26. Each strut is made up of two arms 74, 74 pivotally joined to one another by a pivot pin 76 and each pivotally connected to a respective one of the legs between which the strut extends. As shown in FIGS. 11 and 12, the struts 26, 26 are connected to the intermediate leg sections 22 with the connection 22 to each leg including a connecting part 76 spot welded to the intermediate leg 22 near the pivot axis 38 and with each strut arm associated with a leg being pivotally connected to the connecting part 76 by a pivot pin 78.

In the deployed condition of the frame, the arms 74, 74 of each strut are locked in their relatively aligned positions shown in FIGS. 2 and 16 by a suitable releasable locking means such as the sleeve 80 shown in FIGS. 13, 14 and 15. That is, in the aligned and locked arm situation of FIG. 13, the sleeve 80 fits over the joint between the two arms to prevent relative pivotal movement between such arms; but, the sleeve is slidable to the position of FIG. 15 at which the joint is freed to allow relative rotation between the arms. A spring 82 in the sleeve frictionally holds the sleeve to whatever position it is moved.

It will be understood that when the tent frame is to be collapsed from the position shown in FIG. 2, or from the position shown in FIG. 16, the locking sleeves 80, 80 of the struts are all moved to the FIG. 15 position and thereafter, as the intermediate sections 22, 22 of the legs are moved toward their folded positions relative to the inboard sections 20, 20 of the legs and the inboard sections are moved to their collapsed position parallel to the central axis 34, the arms 74, 74 comprising the struts will pivot relative to one another about the pivot axes 76, 76 and relative to the legs about the pivot axes 78, 78 to permit the folding movement of the leg sections and to likewise themselves fold into a compact condition.

As mentioned, FIG. 16 shows a "partially deployed" condition of the tent frame in which the frame is useful with a wall member to provide a different form or shape of structure from that shown in FIG. 1. The condition of FIG. 16 is, it will be understood, achieved by moving each of the outboard leg sections 24, 24 to their folded position relative to their associated intermediate sections 22, 22 from the position shown in FIG. 2 with all other parts remaining in the same relative positions.

I claim:

1. A tent frame readily changeable between a deployed condition and a compact collapsed condition, said tent frame comprising: a central hub having a central axis oriented vertically in said deployed condition of said frame, a plurality of legs spaced angularly of one another about said central axis, each of said legs including a plurality of sections pivotally connected to one another to enable said sections of each leg to be moved between a relatively spread condition and a relatively folded condition, said sections of each leg including an inboard section having an inboard end adjacent said hub and an outboard end remote from said hub, means connecting said inboard end of the inboard section of each of said legs to said hub for movement relative to said hub about a first pivot axis located in a plane perpendicular to said central axis and perpendicular to a radial line to said central axis, a central part carried by said hub and manually rotatable relative thereto, and a mechanism carried by said hub for simultaneously angularly moving all of said inboard sections of said legs relative to said hub about said first pivot axes in a deploying direction, in which said outboard ends of said inboard sections move away from said axis, in response to rotation of said central part in one direction and in a collapsing direction, in which said outboard ends of said inboard sections move toward said central axis, in response to rotation of said central part in the opposite direction.

2. A tent frame as defined in claim 1 further characterized by each of said legs in addition to said inboard section including an intermediate section and an outboard section, means connecting the outboard end of said inboard section of each leg to the inboard end of said intermediate section of the same leg for movement of said intermediate section relative to said inboard section about a second pivot axis located in a plane perpendicular to said central axis and perpendicular to a radial line from said central axis, whereby said intermediate and inboard sections are movable relative to one another about said second axis between folded and deployed conditions, means associated with said inboard and intermediate sections of each leg for releasably locking said sections in their deployed condition, means pivotally connecting the outboard end of said intermediate section of each leg to the inboard end of the associated outboard section of the same leg for pivotal movement of said intermediate and outboard sections relative to one another about a third pivot axis located in a plane perpendicular to said central axis and perpendicular to a radial line from said central axis, whereby said intermediate and outboard sections are pivotally movable relative to one another about said third pivot axis between folded and deployed conditions, and means associated with said outboard and intermediate sections for releasably locking said intermediate and outboard sections in their deployed condition.

3. A tent frame as defined in claim 1 further characterized by said hub having a plurality of radially extending ears to each of which ears a respective one of said inboard sections of said legs is pivotally connected, said mechanism including a part moved axially along said central axis relative to said hub in response to rotation of said manually rotatable part, and a plurality of links each connected between said axially movable part and a respective one of said legs for simultaneously moving said inboard sections of said legs about said first axes relative to said hub in response to movement of said part along said central axis.

4. A tent frame as defined in claim 1 further characterized by said hub including a hollow central body and said manually rotatable part comprising an axially extending member supported for rotation relative to said hub body about said central axis, said manually rotatable part being threaded along a portion of its length within said housing body, a driving part threadably received on said threaded portion of said manually rotatable member, and a plurality of links each connected between said driving part and a respective one of said inboard sections of said legs for pivoting said inboard sections of said legs simultaneously about said first axes relative to said hub in response to axial movement of said driving part resulting from rotation of said manually rotatable part.

5. A tent frame as defined in claim 4 further characterized by said manually rotatable part at each of its ends including an end portion which projects axially beyond said hub body, each of said end portions of said manually rotatable part being adapted to receive a tool for rotating said manually rotatable part.

6. A tent frame as defined in claim 4 further characterized by said hub body having a plurality of radially extending ears to each of which ears a respective one of said inboard sections of said legs is pivotally connected and said hub body further having a plurality of longitudinally extending slots therein for accommodating said links, each of said slots being located adjacent a respective one of said radially extending ears.

7. A tent frame as defined in claim 1 further characterized by a plurality of struts each, in the deployed condition of said frame, extending between a pair of adjacent ones of said legs to aid in controlling the angular spacing of said legs relative to one another.

8. A tent frame as defined in claim 7 further characterized by each of said struts consisting of two arms pivotally connected to one another and each pivotally connected to a respective one of said legs, said arms in said deployed condition of said frame being generally in line with one another, said arms also being pivotally movable about their common pivot axis to bring said arms into adjacent parallel relationship with one another in said collapsed condition of said frame.

9. A tent frame as defined in claim 8 further characterized by means associated with each of said struts for releasably holding said two arms of said strut in said aligned condition while said frame is in said deployed condition.

10. A tent frame as defined in claim 8 further characterized by said struts being pivotally connected to said legs at points close to said third pivot axes about which said outboard sections of said legs are connected to said intermediate sections.

* * * * *